United States Patent [19]

Hann

[11] Patent Number: 4,724,228

[45] Date of Patent: Feb. 9, 1988

[54] THERMAL TRANSFER DYESHEET

[75] Inventor: Richard A. Hann, Cheshire, England

[73] Assignee: Imperial Chemical Industries PLC, London, England

[21] Appl. No.: 831,721

[22] Filed: Feb. 21, 1986

[30] Foreign Application Priority Data

Feb. 21, 1985 [GB] United Kingdom ..... 8504518

[51] Int. Cl.[4] ..... B41M 5/26

[52] U.S. Cl. ..... 503/227; 8/471; 427/152; 428/207; 428/216; 428/447; 428/913; 428/914; 430/945

[58] Field of Search ..... 8/470, 471; 427/146, 427/152; 428/195, 207, 216, 447, 913, 914; 430/945; 503/227

[56] References Cited

U.S. PATENT DOCUMENTS 3,952,131 4/1976 Sideman ..... 428/914
4,021,591 5/1977 De Vries et al. ..... 428/914
4,058,644 11/1977 De Vries et al. ..... 428/914
4,253,838 3/1981 Mizuno et al. ..... 428/913

FOREIGN PATENT DOCUMENTS 7311409 4/1973 Japan ..... 428/195

*Primary Examiner*—Bruce H. Hess
*Attorney, Agent, or Firm*—Cushman, Darby & Cushman

[57] ABSTRACT

A thermal transfer dyesheet having a printing surface against which a receptor substrate may be held to receive a thermally transferable dye in response to thermal stimuli applied to the dyesheet, the dyesheet comprising a substrate supporting a dyecoat comprising the thermally transferable dye dispersed throughout a polymeric binder, characterized in that the polymeric binder comprises a thermoset silicone composition as a continuous layer overlying the dyecoat, a process for its preparation, and the use of a thermoset silicone composition as a layer overlying the dyecoat.

6 Claims, No Drawings

THERMAL TRANSFER DYESHEET

The invention relates to dyesheets for thermal transfer printing, in which one or more thermally transferable dyes are caused to transfer from a dyesheet to a receiving sheet in response to a thermal stimulus, processes for their preparation, and the use of certain polymers as a coating therein.

Transfer printing has long been used as a means of providing textiles with a decorative pattern, by pressing against them a paper carrying thermally transferable dyes printed onto it in the form of the desired pattern, and applying heat uniformly to the whole area for as long as may be necessary to transfer the preformed pattern to the textile. A more recent development of this is the proposal to use a dyesheet having a substantially uniform distribution of dye, and to produce the desired pattern during the thermal transfer operation by heating only selected areas of the dye sheet. In this way individual letters or numbers can be transferred either whole or in bits, or pictures can be built up pixel by pixel. It is to the dyesheets for this more recent development of forming the desired pattern or information by transfering only selected areas of dyes, to which the present invention particularly relates.

The selected areas of the dyesheet may be heated, for example by using a thermal print head or addressable laser, both being particularly suited to computer control in respect of the position of the areas to be heated and to the degree of heating, and in this manner hard copies of still pictures, including coloured pictures (e.g. by printing different colours sequentially), or data and other information, can be reproduced directly from magnetic disks or tapes, laser-readable disks and other forms of stored electronic signals, under the computer control. A desire for high resolution printing by such methods has led to the replacement of paper as the basis for the dyesheets by more uniform and consistent thermoplastic film, usually polyester film such as "Melinex" polyethyleneterephthalate film, the dyes being held on the surface of the film by a suitable polymeric binder. However, for high speed printing (to which such processes are particularly suited) it is necessary to give short duration stimuli, which in turn require higher temperatures in order to provide sufficient thermal energy, but this has led in the past to local melt-bonding between the dyesheet and receptor substrate (which may also be thermoplastic film), thus excessively transferring areas of the dyecoat to the receptor. This can be mitigated to some extent by using cross-linked thermoset resins as binders for the dye, as has previously been suggested. However such solutions have not proved entirely successful, tending at one extreme to restrict or disperse the flow of the dye molecules through the binder to the receptor sheet, or at the other extreme still to permit some adhesion. We have now found that we can minimise the adhesion while retaining a rapid and precise transfer of the dyes, by using thermosetting silicones in the dyesheet.

Accordingly the present invention provides a thermal transfer dyesheet having a printing surface against which a receptor substrate may be held to receive a thermally transferable dye in response to thermal stimuli applied to the dyesheet, the dyesheet comprising a substrate supporting a dyecoat comprising the thermally transferable dye dispersed as solid particles throughout a polymeric binder, characterised in that the printing surface comprises a thermoset silicone composition as a continuous layer overlying the dyecoat.

We have found such continuous layers to produce no noticeable loss of resolution nor substantial hindrance to the dye molecules during thermal transfer. The provision of the silicone in the form of such overlying layers also appears to avoid any compatibility problems between the silicone and the dye (these being potential problems referred to in more detail below).

The present invention also provides the use of a thermosetting silicone composition as a layer overlying a thermal transfer dyecoat.

Silicones within the thermoset silicone composition which are generally available include polysiloxane resins which are designed to be cured by platinum-based catalysts, and those designed to be cured by tin-based catalysts, the former generally being the more rapidly cured and being the more commonly used for other purposes. With the platinum catalysed systems, incompatibility with the dyecoat could manifest itself in the form of catalyst poisoning, leading to lower degrees of cross-linking, or by migration of the dye molecules through the cross linked silicone to exude from the surface. Such problems however, and their degree, vary from dye to dye, and as noted above appear to be avoided in the present invention.

Suitable polymeric binders for the dyecoat include conventional binders for such purposes for instance cellulose derivatives such as cellulose ethers and esters, such as alkyl hydroxyalkylcelluloses, for example methyl and ethyl hydroxyethylcellulose.

The thermally transferable dyes are dispersed as solid particles throughout the binder. The optimum quantity may be limited by compatability but when testing some dispersions we found that the highest dye concentrations give the highest optical densities of transferred dye, good optical densities occuring when using dye concentrations of about 100 g per 100 g of polymeric binder, polymer ranges of from 20 to 200 g per 100 g of binder giving the best results under the conditions of testing, as described in more detail in the Example below. Usable results were, however, obtained over a much wider range of about 10 to 300 g/100 g of binder. A surfactant may be added to the dyestuff dispersion, and tends to increase the transferred dye optical density. The use of less polar dispersing solvents or solvent mixtures also tends to increase the same optical density.

The thickness of the dyecoat determines the quantity of dye available for transfer from any specific composition. When using dye concentrations within our preferred ranges above, particularly suitable thicknesses for the dyecoat ranged from 1 to 10 $\mu$m, although less than 5 $\mu$m is preferred. For highly dispersable dyes, dyecoats of about 2 $\mu$m thickness are generally appropriate.

The silicone composition layer is preferably within the thickness range of 0.05 to 5 $\mu$m, around 0.07 to 1 $\mu$m being generally appropriate.

All the above measurements being made on the coatings, i.e. after removal of any solvent used in their preparation.

The present invention also provides a process for preparing a dyesheet of the invention, characterised by coating a dyecoat comprising a thermally transferable dye onto a substrate, as necessary drying the dyecoat, spreading a thermosetting silicone composition onto the dyecoat, and thermosetting the silicone composition.

Most of the normal film-coating techniques can be used to spread the dyecoat and/or overlying silicone layer. We have successfully used Meyer bars, for example, but generally prefer gravure rollers as these give particularly good control over the process.

Conventional curing techniques may be used for thermosetting the overlying silicone composition layer. For example, with the tin- or platinum-catalysed curable resins referred to hereinbefore, the resin may be set by heating for 10 to 30 sec at 80°-120° C.

At the present state of this technology, dyesheets have a single dye colour dispersed throughout a polymeric binder, and spread uniformly over the supporting substrate although that single colour may be made up of an intimate mixture of different dye molecules. For multicolour prints, the various colours are transferred sequentially, either by changing the dyesheet altogether, or more usually by moving on a dyesheet roll having large blocks of colour which are placed between the print head and the receptor sheet in turn. However, it is envisaged that a future dyesheets may contain several colours, probably three, arranged in very small clusters or narrow adjacent rows, such that each pixel could be printed with the appropriate colour or combination of the colours according to which minute area is heated, thereby avoiding having to move the dyesheet to change the colour. Each cluster or row being respectively very small or narrow as it would determine the ultimate resolution of the system, yet being sufficiently wide to be independently addressable by the means providing the thermal stimulus. Difficulties envisaged for such dye sheets reside in registration of the dye sheet with respect to the means for providing the thermal stimulus, such that the correct colour is transferred for each pixel, but such registration problems are not the subject of the present invention. However such dyesheets would appear to be substantially uniform to the naked eye, and the process of heating only selected areas of the dyes to build up a picture pixel by pixel would be essentially the same. Thus any melt-adhesion problems arising during printing would be derived from the materials and temperatures employed, rather than the arrangement of the dyes, and the provisions of the present invention would be equally applicable and advantageous to such multi-dye dyesheets. It is therefore not intended that they should be excluded in or by any reference herein to a uniform dyesheet or dyecoat.

The invention is illustrated by reference to the following Example:

EXAMPLE p (a) A dye dispersion was prepared for "Dispersol" Red B2B dye, including ethyl hydroxyethylcellulose (EHEC) as binder precursor and using as solvent a mixture of SPB3 petroleum distillate and isopropanol. The dye dispersion had the following composition.

| | parts by weight |
|---|---|
| Red B2B dye | 5 |
| EHEC | 5 |
| Dispersing agent | 3 |
| Solvent | 100 |

The dye dispersion was applied to the surface of a Melinex film and allowed to dry, thereby forming a dyecoat of red dye in EHEC. The thickness of the dry dyecoat was about 2 μm.

A coating composition having the following proportions was prepared:

| | | parts of weight |
|---|---|---|
| Silcolease resins 425 | ICI | 100 |
| Crosslinking agent 62A | ICI | 3 |
| Tin-based Catalyst 62B | ICI | 3 |
| Petroleum Ether (bp 80/100° C.) | ICI | 100 |

The coating composition was spread onto the dyecoat using a Meyer bar, the solvent removed and the coating heated briefly to cross-link the resins, for about 20 seconds at 90° C. The thermoset layer so formed was about 1 μm thick.

When using a thermal printer to transfer the dye, rapid transfer was obtained, with no noticeable evidence of any increased lateral flow of dye molecules to reduce the resolution. The overlying layer gave good protection against adhesion, although small patches of dyecoat tended to come off and adhere to the receptor sheet.

By contrast substantial adhesion occured when using the same printer on an area having only the dye in EHEC dyecoat, i.e. without any silicone composition as topcoat.

The printer head reached a temperature of about 360° C. in about 10 ms, except where less energy was used when investigating the effects of lower energies. Other dyes may require different temperatures and/or pulse durations to achieve optimum thermal transfer.

Dyesheets of the present invention may be similarly prepared using the following compositions:

| (b)-(e) Dye dispersion | parts by weight |
|---|---|
| EHEC | 5, 10, 20, 40 |
| Dispersol Red B2B dye | 2.5, 5, 10, 20 |
| Toluene | 242.5, 485, 970, 1940 |
| Coating composition | |
| Silicone (30% solids solution) EP6553 | 62.5 |
| Cross-linking agent EP6552 | 1.25 |
| Platinum-based catalyst (15% in toluene) EP6530 | 5 |
| Toluene | 600 |

Examples (a) to (e) may be repeated reducing the quantity of coating composition to give thermoset layers 0.06, 0.12 and 0.47 μm thick.

I claim:

1. A thermal transfer dyesheet having an outermost printing surface against which a receptor substrate may be held to receive a thermally transferable dye in response to thermal stimuli applied to the dyesheet, the dyesheet comprising a substrate supporting a dyecoat comprising the thermally transferable dye dispersed as solid particles throughout a polymeric binder, characterised in that the printing surface comprises a thermoset silicone composition as a continuous layer overlying the dyecoat.

2. A dyesheet according to claim 1, characterised in that the thermoset silicone composition comprises a polysiloxane resin cured with a tin- or platinum-based catalyst.

3. A dyesheet according to claim 1, characterised in that the binder is a cellulose ether or ester derivative.

4. A dyesheet according to claim 1, characterised in that the dye concentration in the dyecoat is from 2 to 200 g dye per 100 g binder, the dyecoat is less than 5 μum thick, and the silicone composition layer is from 0.07 to 1 μm thick.

5. A thermal transfer dyesheet comprising: a substrate; a dyecoat on the substrate, the dyecoat comprising a thermally transferable dye dispersed as solid particles throughout a polymeric binder; and an outer continuous layer overlying the dyecoat for directly contacting a receiving sheet which receives thermally transferable dye from the dyecoat in response to thermal stimuli applied to the dyesheet, said outer continuous sheet comprising a thermoset silicone composition which is non-adhesive to the receiving sheet and which reduces the tendency of the dyecoat to adhere to the receiving sheet while permitting transfer of dye through the silicone composition to the receiving surface.

6. A method of thermal transfer printing using a thermal dyesheet, which dyesheet comprises a substrate, a dyecoat particles throughout a polymeric binder and an outer continuous layer of a thermoset silicone composition overlying the dyecoat, said method comprising applying the dyesheet to a dye-receiving sheet with the silicone layer of the sheet being in direct contact with the dye-receiving sheet, applying a thermal stimulus to the dyesheet to cause dye to transfer from the dyecoat through the silicone layer to the dye-receiving sheet, the silicone layer reducing the tendency of the dyecoat to adhere to the dye-receiving sheet, and removing the dyesheet, including the silicone layer from the dye-receiving sheet.

* * * * *